US007523575B1

(12) United States Patent
Nettles

(10) Patent No.: US 7,523,575 B1
(45) Date of Patent: Apr. 28, 2009

(54) METHOD AND APPARATUS FOR CELEBRATION MONEY HANGER

(76) Inventor: Alice Nettles, 1301 McKenzie Ave., Tuskegee, AL (US) 36083

( * ) Notice: Subject to any disclaimer, the term of this patent is extended or adjusted under 35 U.S.C. 154(b) by 0 days.

(21) Appl. No.: 12/082,663

(22) Filed: Apr. 14, 2008

Related U.S. Application Data

(60) Provisional application No. 60/911,944, filed on Apr. 16, 2007.

(51) Int. Cl.
*G09F 3/18* (2006.01)

(52) U.S. Cl. ..... 40/661.04; 40/661.11; 40/667; 24/13

(58) Field of Classification Search ..... 40/661.04, 40/661.11, 667, 1.5; 24/13, 3.3, 3.9, 3.6, 24/6

See application file for complete search history.

(56) References Cited

U.S. PATENT DOCUMENTS

| | | | | | |
|---|---|---|---|---|---|
| 866,379 | A | * | 9/1907 | Monroe | 40/667 |
| 1,089,956 | A | | 3/1914 | Polyanich | |
| 2,035,789 | A | * | 3/1936 | Collins | 40/1.5 |
| 2,863,235 | A | * | 12/1958 | Krause | 40/1.5 |
| 2,954,593 | A | * | 10/1960 | Matelan | 24/13 |
| 3,555,623 | A | | 1/1971 | Cocchiaraley | |
| 4,903,379 | A | * | 2/1990 | Uchtman | 24/351 |
| 5,481,758 | A | | 1/1996 | Gabler | |
| 5,647,099 | A | * | 7/1997 | Cohen | 24/3.3 |
| 6,148,550 | A | | 11/2000 | Niedfeld | |
| D441,687 | S | * | 5/2001 | Anderson | D11/95 |
| 2006/0230501 | A1 | * | 10/2006 | Roudeze, IV | 2/265 |
| 2007/0277416 | A1 | | 12/2007 | Fedan | |

OTHER PUBLICATIONS

"Money Dance," http://flickr.com/photos/74812989@N00/818927/, Oct. 11, 2004.*

"Wedding Dances," http://web.archive.org/web/20060114173549/http://www.lovemusiclovedance.com/wedding_dj/wedding-dance-money-dance.htm, Jan. 14, 2006.*

* cited by examiner

*Primary Examiner*—Gary C Hoge
(74) *Attorney, Agent, or Firm*—George L. Williamson

(57) ABSTRACT

A method and apparatus is disclosed for attaching monetary gifts to the clothing being worn by user. The method and apparatus discloses a badge-like portion having a celebratory greeting message disclosed on the front side thereof and a clip on the rear side for attaching the badge in the lapel area of clothing being worn by the user. Also being attached to the rear surface of the badge is a wire attachment means having a pair of ends wherein one end can be threaded through the money so that the ends of the wire can then be reattached to the rear of the badge portion.

1 Claim, 1 Drawing Sheet

METHOD AND APPARATUS FOR CELEBRATION MONEY HANGER

RELATED APPLICATIONS

This application relates to U.S. Provisional Patent Application Ser. No. 60/911,944 filed on Apr. 16, 2007.

BACKGROUND OF THE INVENTION

1. Field of the Invention

The present invention generally relates to money holders, and, more particularly, is concerned with a method and apparatus for a celebration money hanger for use in the lapel area of clothing being worn by the user.

2. Description of the Prior Art

Devices related to money hangers have been described in the prior art, however, none of the prior art devices disclose the unique features of the present invention.

U.S. Patent Application Publication No. 2006/0230501, dated Oct. 19, 2006 to Roudeze, IV disclosed a festive garment with fasteners which can be used to hold money. U.S. Pat. No. 1,089,956 dated Mar. 10, 1914, to Polyanich disclosed a tag having a clip thereon for connection of tags and receipts thereto. U.S. Patent Application Publication No. 2007/0277416 dated Dec. 6, 2007 to Fedan disclosed an ornamental gift card holder. U.S. Pat. No. 6,148,550 dated Nov. 21, 2000 to Niedfeld disclosed a money pocket. U.S. Pat. No. 5,481,758 dated Jan. 9, 1996 to Gabler disclosed a garment having a message relating to money printed thereon. U.S. Pat. No. 3,555,623, dated Jan. 19, 1971 to Cocchiaraley disclosed a money clip for holding money.

While these devices related to money holders may be suitable for the purposes for which they were designed, they would not be as suitable for the purposes of the present invention, as hereinafter described.

SUMMARY OF THE PRESENT INVENTION

The present invention discloses a method and apparatus for attaching monetary gifts to the clothing being worn by user. The method and apparatus discloses a badge-like portion having a celebratory greeting message disclosed on the front side thereof and a clip on the rear side for attaching the badge in the lapel area of clothing being worn by the user. Also being attached to the rear surface of the badge is a wire attachment means having a pair of ends wherein one end can be threaded through the money so that the ends of the wire can then be reattached to the rear of the badge portion.

An object of the present invention is to enable the recipient to safely and creatively secure and display monetary gifts received for a special occasion being generally worn in the lapel area on the clothing of the user. A further object of the present invention is to provide a holder which can be offered in a variety of designs that corresponds with specific events or milestones in the life of the user including, e.g., birthdays, weddings, baby showers and graduations. A further object of the present invention is to provide a money holder which can be easily and conveniently used by the user. A further object of the present invention is to provide a money hanger which can be easily and relatively inexpensively manufactured.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
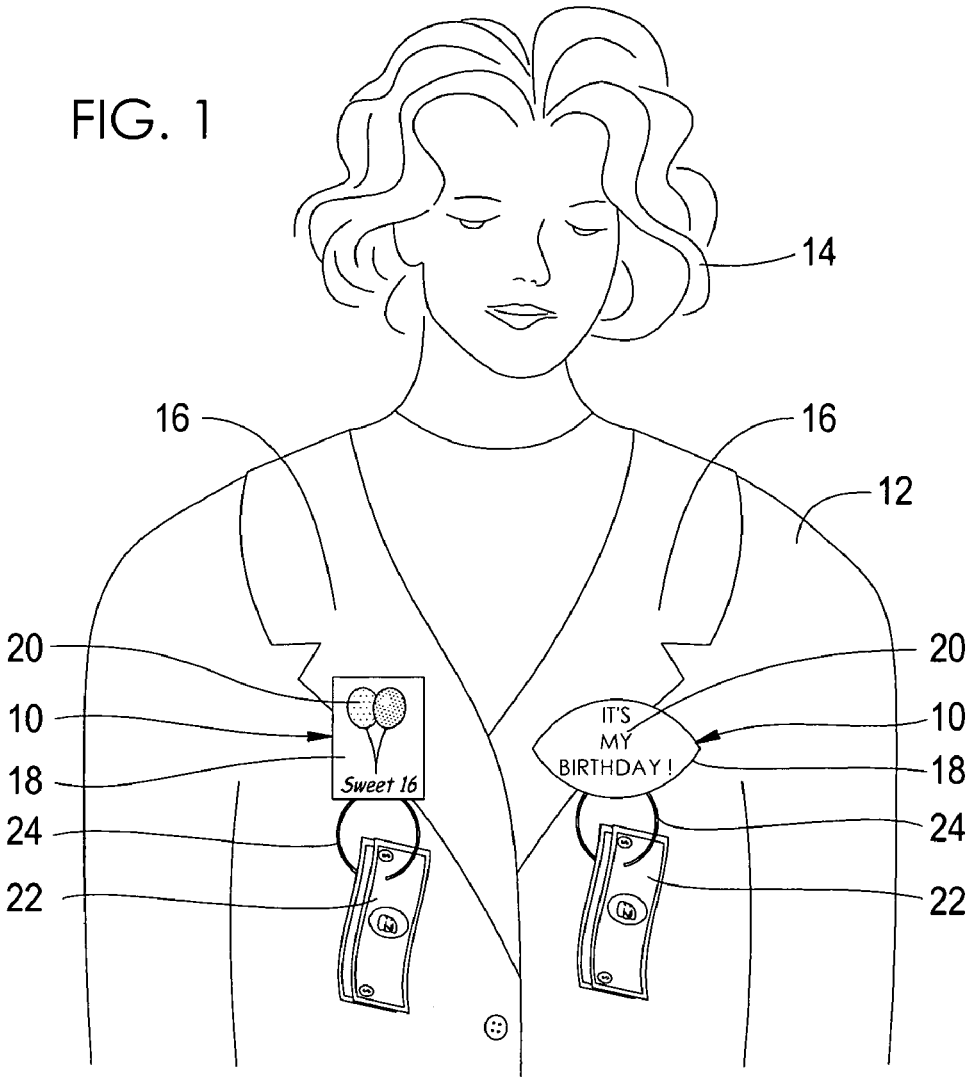
FIG. 1 is a plan view of the present invention in operative connection on a user.

With regard to reference numerals used, the following numbering is used throughout the drawings.

10 present invention
12 clothing
14 user
16 lapel
18 badge portion
20 exemplary greeting
22 paper money
24 wire member
26 rear of the badge
28 clasp
30 pin
32 hook
34 wire member
36 first end of wire member
38 second end of wire member
40 first receptacles
42 second receptacle

DETAILED DESCRIPTION OF THE PREFERRED EMBODIMENT

Figure 2:
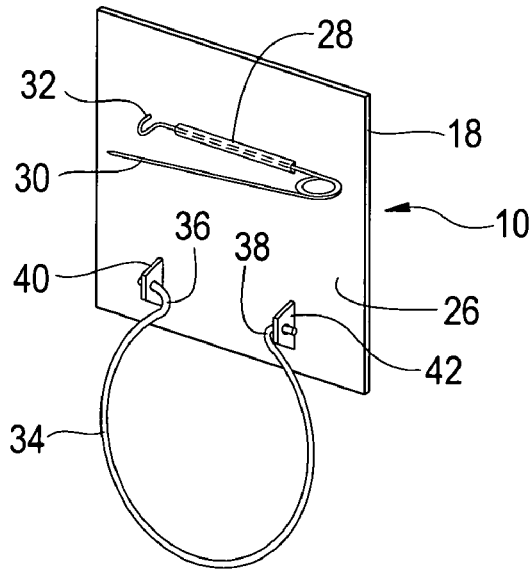
FIG. 2 is a perspective view of the rear of the present invention.

The following discussion describes in detail the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 2 shows the present invention wherein a money hanger is disclosed.

Turning to FIG. 1, therein is shown the present invention 10 attached to the clothing 12 of a user 14 in the lapel area 16 of the clothing being worn by the user. The present invention 10 comprises an upper badge-like portion or body 18 having a greeting message 20 disclosed on its front. FIG. 1 discloses two exemplary greeting messages 20 "Sweet 16" and "It's My Birthday" which may be brightly colored. However, there are many additional celebratory messages that could be used in conjunction with birthdays, weddings, baby showers and graduations. Also disclosed is paper money 22 in the form of bills attached to the present invention 10 by passing a wire-like member 24 through the bill so that the wire member and bill can be attached to the body portion 18 of the present invention.

Turning to FIG. 2, therein is shown present invention 10 having a body or badge portion 18 having a rear side 26 having attached thereon a safety pin-like or clip member 28 for attaching the badge 18 to the clothing of the user. A clasp 28 being a safety pin-like member having a spring tension pin member 30 for connection to a hook-like member 32 thereon in the conventional manner. Also disclosed is a wire member 34 having a first end 36 and second end 38, each of which ends being biased away from each other are hooked into the receptacle member 40 and 42. In operation, one end of the member 34, for example, 38 can be removed from receptacle 42 passed or threaded through the bill 22 (not shown, but see FIG. 1) then reinserted into receptacle 42 so that the bill can be attached to the body 18 and then the body attached to the clothing of the user.

By way of general explanation, the present invention 10 is a decorative yet functional accessory used to pin monetary gifts to the lapel areas of a user. Constructed from plastic, resin, heavyweight paper or other similar cost-effective materials, the base 18 is similar to a brooch, with an attachment pin structure 28 located on the rear of the base. This closure mechanism ensures that the money hanger will not accidentally fall off during wear. An additional member 34 with a hook-type closure is positioned below the pin member 28. Member 34 is easy to open or close and is designed for use when affixing the money bill 22 to the present invention 10 and once attached, the bills will hang below the base 18 of the unit. In order to be useful for a wide range of occasions, the present invention 10 is offered in a variety of fun, colorful designs that can be worn for birthdays, wedding showers, baby showers and graduations. It is suitable for both males and females and can be worn by individuals of all ages. While it is an aesthetically pleasing solution for the day of the event, the present invention 10 ensures that the bills 22 remain secure and will not be lost or misplaced before use, and makes a lovely scrapbook accessory or memento of the important occasion. While the exact dimensions of the present invention 10 will vary, the item should be large enough to be prominent or eye-catching on the user's lapel area. Additional accoutrements can be integrated into the design upon manufacture.

I claim:

1. A method for attaching paper money to the clothing of a user, comprising the steps of:

a) providing a body having a front and a rear side;

b) providing a celebratory message on the front side of the body;

c) attaching the body to the clothing of the user so that the body is removably attached to the clothing of the user;

d) attaching the paper money to the body so that the paper money is removably attached to the body;

e) providing a wire member for attaching the paper money to the body, wherein the wire member is shaped like a horseshoe having a first and second end, wherein the first and second ends are biased away from each other;

f) providing a first and second receptacle on the rear side of the body, wherein the first end of the wire member can be attached to and removed from the first receptacle and the second end of the wire member can be attached to and removed from the second receptacle; and, g) removing the first end of the wire member from the first receptacle and passing the first end through the paper money, and, reattaching the first end of the wire member to the first receptacle so that the paper money can be removably attached to the body.

* * * * *